US006056649A

United States Patent [19]

Imai

[11] Patent Number: 6,056,649

[45] Date of Patent: May 2, 2000

[54] GOLF CLUB HEAD

[75] Inventor: Yasuto Imai, Higashikurume, Japan

[73] Assignee: Daiwa Seiko, Inc., Tokyo, Japan

[21] Appl. No.: 09/174,407

[22] Filed: Oct. 19, 1998

[30] Foreign Application Priority Data

Oct. 21, 1997 [JP] Japan ..... 9-288547

[51] Int. Cl.[7] ..... A63B 53/04

[52] U.S. Cl. ..... 473/328; 473/334; 473/345

[58] Field of Search ..... 473/328, 338, 473/334, 344, 349, 345, 346

[56] References Cited

U.S. PATENT DOCUMENTS

| | | |
|---|---|---|
| 1,913,821 | 6/1933 | Stumpf . |
| 2,014,829 | 9/1935 | Young . |
| 2,332,342 | 10/1943 | Reach . |
| 3,680,868 | 8/1972 | Jacob . |
| 3,761,095 | 9/1973 | Thompson . |
| 4,085,934 | 4/1978 | Churchward . |
| 4,498,673 | 2/1985 | Swanson . |
| 4,775,156 | 10/1988 | Thompson . |
| 4,795,159 | 1/1989 | Nagamoto . |
| 5,658,207 | 8/1997 | Aizawa . |
| 5,807,188 | 9/1998 | Serrano . |

FOREIGN PATENT DOCUMENTS

| | | |
|---|---|---|
| 7-313636 | 5/1995 | Japan . |

*Primary Examiner*—Sebastiano Passaniti

*Attorney, Agent, or Firm*—Liniak, Berenato, Longacre & White

[57] ABSTRACT

A golf club head includes a pair of protrusions integral with a sole. Each protrusion elongates in a swing direction and protrudes downward from the sole. A weight having a larger specific gravity than the sole is accommodated in the protrusions.

18 Claims, 4 Drawing Sheets

GOLF CLUB HEAD

BACKGROUND OF THE INVENTION

1. Field of the Invention

The present invention relates to a golf club head, and more particularly to a golf club having a lowered position of the center of gravity of the club head and providing a smooth follow-up swing of the club head and an increased flying distance of the golf ball.

2. Description of Related Art

Japanese Patent Laid-Open Publication No. Hei-7-313636 discloses a golf club head having the construction as shown in FIG. 5 through 8. As shown, bar-like members 5, square in cross section, are arranged side by side on a sole 3 of a golf club head 1, while being partially protruded outward from the sole 3. Provision of those bar-like members 5 enables the sole 3 to be well slidable on the surface of land, and hence provides a good swing (a smooth follow-up swing). Further, the lowering of a position of the gravity center of the club head is realized since a metallic material having a larger specific gravity than the material of a head body 7 is used for making the bar-like members 5. The lowering of a position of the gravity center contributes to increase of a flying distance of the ball.

As shown, the golf club head 1 includes the head body 7 made of titanium, a sole plate 9 attached to the sole of the head body 7, and the bar-like members 5 mounted on the sole plate 9. A plurality of elongated grooves 11 are arrayed in the sole plate 9, extending in the back-and-forth directions of the club head (FIGS. 6 to 8). To manufacture, members 13 of beryllium kappa (i.e., the bar-like members 5) are pressure-inserted into the elongated grooves 11 in the inside-to-outside direction of the club head. Then, the materials 13 are compressed to be plastically deformed so that the bar-like members 5 are fixedly mounted to the sole plate 9. The sole plate 9 having the bar-like members 5 mounted thereto is bonded to the head body 7 by welding, etc.

In the golf club head 1, the bar-like members 5, which are separate members from the sole plate 9, are protruded downward from the sole 3 (FIGS. 5 and 8). The bar-like members 5 directly receive impact from the surface of land when the club head hits the ball. Therefore, with a long time use of the club head, the bar-like members 5 will be loosened, damaged or broken, and possibly be removed from the sole plate 9.

SUMMARY OF THE INVENTION

Accordingly, an object of the present invention is to provide a golf club head which maintains the lowered gravity center position of the head body for a long time, while securing a smooth follow-up swing property of the golf club.

To achieve the above object, the present invention provides a golf club head, which includes at least one protrusion integral with a sole, elongating in a swing direction and protruding downward from the sole, and a weight having a larger specific gravity than the sole is accommodated within the at least one protrusion.

When a golf ball is hit with a golf club provided with the golf club head, a smooth follow-up swing can be done since the sole well slides on the surface of land with the aid of the protrusion of the sole. The ball flies high to secure an increased flying distance of the ball since the use of the weight lowers a position of the gravity center of the club head.

The weight is accommodated within the protrusion and the protrusion per se is formed integral with the sole. This arrangement eliminates a possibility that the protrusions are damaged or broken by impact caused when the head strikes a golf ball.

It is preferable that the at least one protrusion has an opening at a protruding distal end thereof, and the weight is exposed through the opening and is flush with the distal end.

The weight is exposed through the opening of the protrusion and can be viewed by the golfer. Further, the weight is held by the protrusion and the protrusion per se is formed integral with the sole. The protrusion is prevented from being damaged or broken by impact caused when the head strikes a golf ball.

The present disclosure relates to the subject matter contained in Japanese patent application No. Hei. 9-288547 (filed on Oct. 21, 1997), which is expressly incorporated herein by reference in its entirety.

BREIF DESCRIPTION OF THE DRAWINGS

DETAILED DESCRIPTION OF THE PREFERRED EMBODIMENTS

The preferred embodiments of the present invention will be described in detail with reference to the accompanying drawings.

Figure 1:
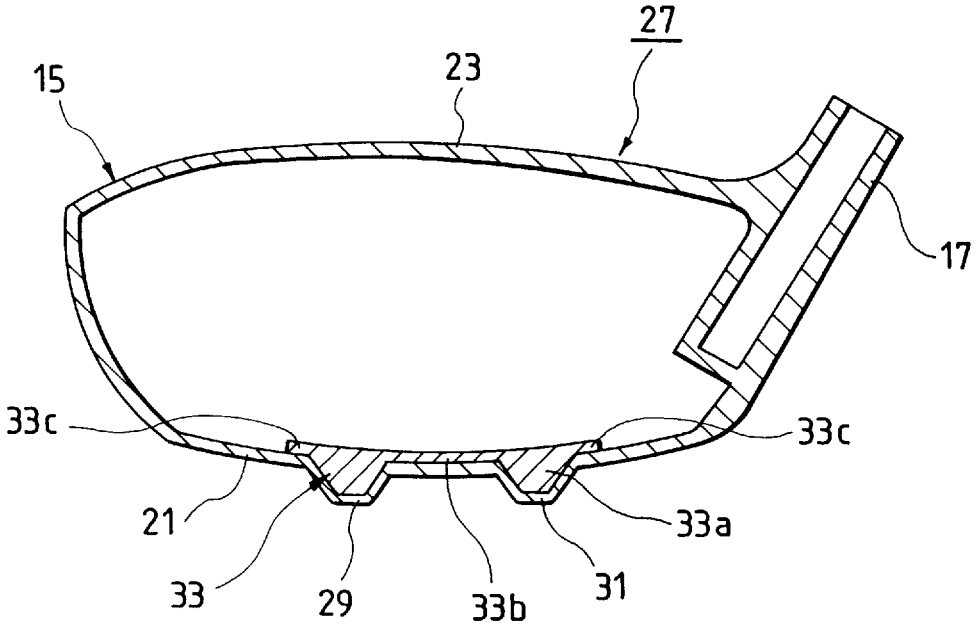
FIG. 1 is a longitudinal sectional view showing a golf club head which is an embodiment of the invention.
Figure 2:
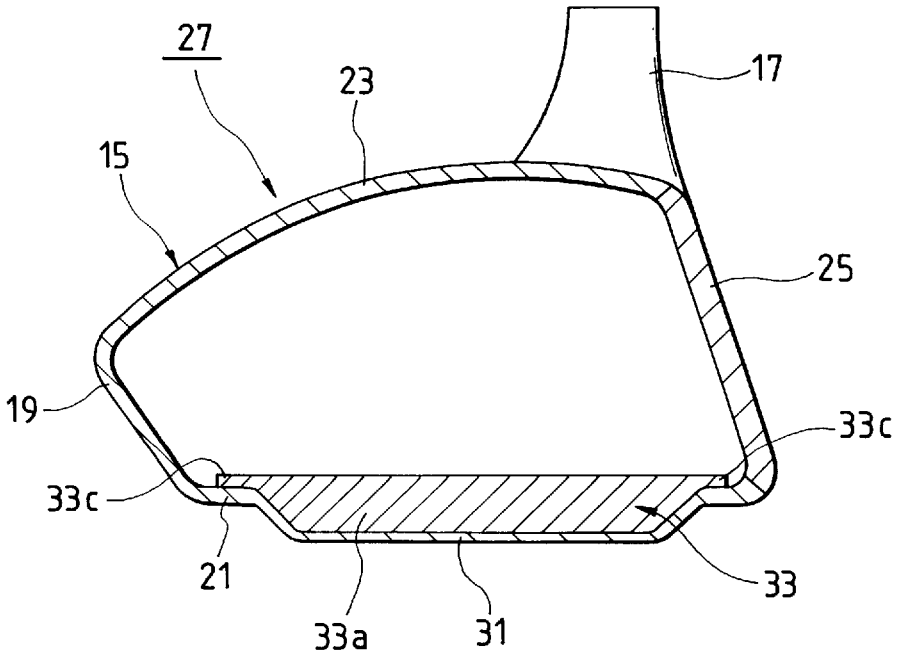
FIG. 2 is a cross sectional view showing the golf club head shown in FIG. 1.

FIGS. 1 and 2 show a wood-type golf club head according to an embodiment of the present invention. A golf club head 27 is generally constructed with a club head body 15 and a face plate 25. The club head body 15 is a one-piece molded, hollow shell, which is made of a metallic material, e.g., stainless, aluminum, or an magnesium alloy, and includes a hosel 17, a back portion 19, a sole 21, and a top portion 23. One end of the club head body 15 is opened. A ball-striking face plate 25 is welded to the opened end of the club head body 15 (FIG. 2). A material of the face plate 25 is the same material as of the club head body 15.

A pair of rib-like protrusions 29 and 31, each being trapezoidal in cross section, are formed integral with the thin sole 21 to elongate in a swing direction. The protrusions 29 and 31 are arrayed parallel to each other. The sole 21 is partially bent downward to form those protrusions 29 and 31. Therefore, the inner surface of the sole 21 is partially curved downward to form recesses. The recesses are substantially coincident in their configuration with the protrusions, respectively. A weight member 33 to be described later in detail is located in the recesses. In the embodiment under discussion, the protrusions 29 and 31 are provided on the sole 21. Provision of the protrusions reduces a contact area of the club head with the surface of land, thereby facilitating a smooth sliding of the sole 21 on the land surface. Further, the protrusions serve to guide the club head when it is swung, thereby preventing the shift of the club head during the swing.

The weight member 33 is mounted on the inner surface of the sole 21 within the club head body 15 and firmly attached thereto by adhesive. The weight member 33 is made of a metallic material, e.g., tungsten or brass, having a larger specific gravity than the club head body 15. Provision of the weight member 33 lowers a position of the center of gravity of the golf club head 27.

The weight member 33 is formed with a pair of weight protrusions 33*a*, a coupling plate 33*b* and a collar portion 33*c*. Each of the weight protrusions 33*a* is configured so as to be received by the corresponding protrusion 29, 31. The coupling plate 33*b* interconnects the weight protrusions 33*a*. The collar portion 33*c* surrounds the weight protrusions 33*a* and the coupling plate 33*b*. When the weight protrusions 33*a* are received by the protrusions 29 and 31, the thin coupling plate 33*b* and the thin collar portion 33*c* are brought into contact with the inner surface of the sole 21.

The weight member 33 is fastened to the inner surface of the sole 21 before the face plate 25 is welded to the opened end of the club head body 15 of the hollow shell. To the fastening work, the surface of the weight member 33 on the weight protrusions 33*a* side is entirely coated with adhesive, and the coupling plate 33*b* and the collar portion 33*c* are brought into contact with the inner surface of the sole 21, while the weight protrusions 33*a* of the weight member 33 are accommodated within the protrusions 29 and 31. The weight protrusions 33*a* are located below the surface of the sole 21 and inside the protrusions 29 and 31, thereby lowering a position of the center of gravity of the golf club head 27.

When a golf ball is hit with a golf club provided with the golf club head 27 thus constructed, a good swing (smooth follow-up swing) can be done since the sole 21 well slides on the surface of land with the aid of the protrusions 29 and 31 of the sole 21. Further, the ball flies high to secure an increased flying distance of the ball since the use of the weight member 33 lowers a position of the gravity center of the club head 27.

The weight member 33 is partially accommodated within the protrusions 29 and 31 and the protrusions per se is formed integral with the sole 21. This arrangement eliminates a possibility that the protrusions are damaged or broken by impact caused when the club head strikes a golf ball.

Therefore, the golf club head 27 can be used for a long time period with the lowered gravity center position in the golf club head 27 and the smooth follow-up swing property.

Figure 3:
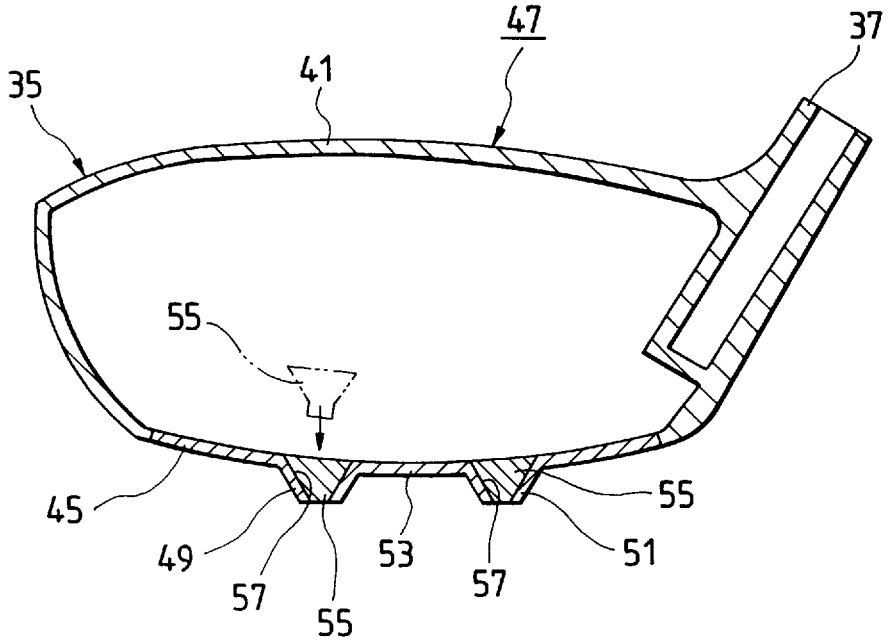
FIG. 3 is a longitudinal sectional view showing a golf club head which is another embodiment of the invention.
Figure 4:
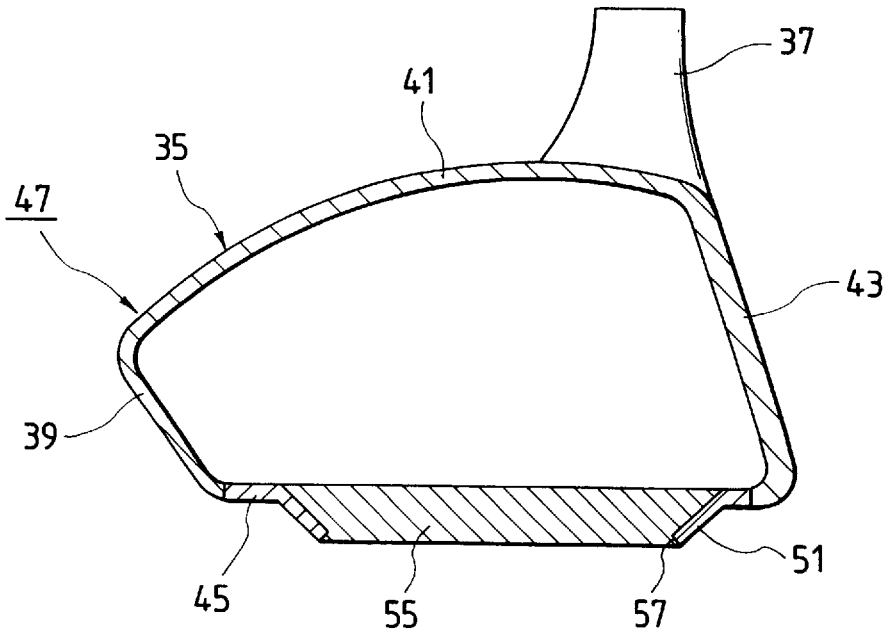
FIG. 4 is a cross sectional view showing the golf club head shown in FIG. 3.
Figure 5:
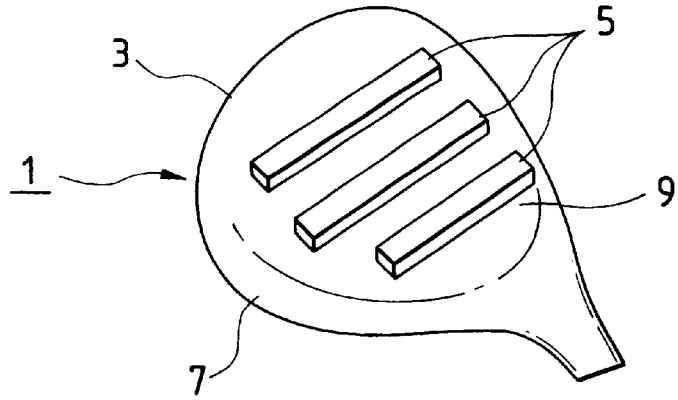
FIG. 5 is a perspective view showing mainly a sole of a conventional golf club head.
Figure 6:
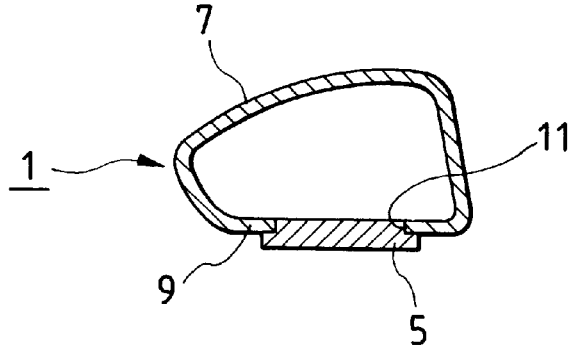
FIG. 6 shows a cross sectional view of the golf club head shown in FIG. 5.
Figure 7:
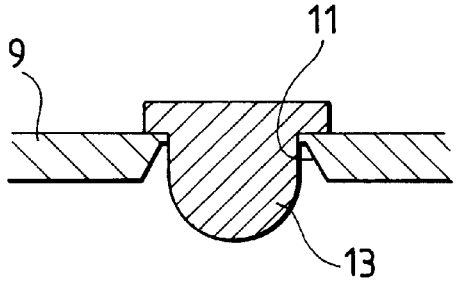
FIG. 7 is a cross sectional view showing how to construct a protrusion in the sole plate of the FIG. 5 club head.
Figure 8:
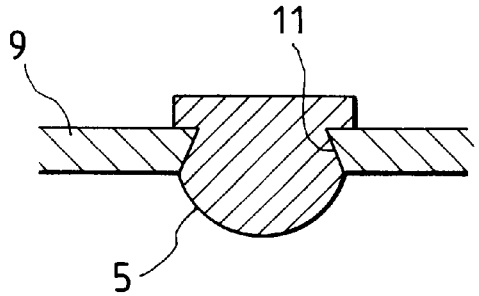
FIG. 8 is a cross sectional view showing one of the protrusions after constructed, in connection with the sole plate.

FIGS. 3 and 4 show another wood-type golf club head according to the present invention. As shown, a golf club head 47 is generally constructed with a club head body 35 and a face plate 43. The club head body 35 is a one-piece molded, hollow shell, which is made of the same material as of the club head body 15, and includes a hosel 37, a back portion 39, a top portion 41, and a ball-striking face 43. A lower portion of the hollow shell is opened. A sole plate 45 is welded to the opened lower portion of the hollow shell, or the club head body 35. The sole plate 45 is made of the same material as of the club head body 35.

As shown, a pair of protrusions 49 and 51, each being trapezoidal in cross section, are formed integral with the thin sole plate 45 to extend in the swing direction. The protrusions 49 and 51 are arrayed parallel to each other. The sole plate 45 is bent downward to form those protrusions 49 and 51. Therefore, the inner surface of the sole plate 45 is curved downward to form recesses substantially corresponding in shape to the protrusions 49 and 51, respectively. Weight members 55 to be described later are received by those recesses, respectively. The protrusions 49 and 51 are provided on the sole plate 45, which forms a sole 53 of the golf club head 47. Provision of the protrusions 49 and 51 reduces a contact area of the club head 47 with the surface of land, and hence facilitates a smooth sliding of the sole 53 on the land surface. Further, the protrusions 49 and 51 serve to guide the club head 47 when it is swung, and prevents the club head 47 from being shifted from the intended locus of the club head during the swing.

The protrusions 49 and 51 are concurrently formed during the process of punching a plate member into the sole plate 45.

The weight members 55, which are made of the same material as of the weight 33, are pressure-fitted into the protrusions 49 and 51, to thereby lower a position of the gravity center of the golf club head 47. Elongated holes 57 are respectively formed in the tops of the protrusions 49 and 51 to extend in the head swing direction. Before the sole plate 45 is welded to the club head body 35, the weight members 55 having configurations resembling those of the protrusions 49 and 51 (depicted by a two-dots chain line in FIG. 3) are fitted and pressured into the protrusions 49 and 51, respectively, to be plastically deformed. As a result, the ends of the weight members 55 engage with the elongated holes 57 formed in the tops of the protrusions 49 and 51, whereby the weight members 55 are firmly fixed. In this case, the weight members 55 are exposed through the elongated holes 57 while being flush with the top faces of the protrusions 49 and 51. The golfer can view the exposed weight members 55 and recognize the installation of the weight members 55.

In this embodiment, the weight members 55 are exposed through the elongated holes 57 while being flush with the top faces of the protrusions 49 and 51. This feature more lowers the gravity center position in the golf club head 47 than in the golf club head 27.

Figure 9:
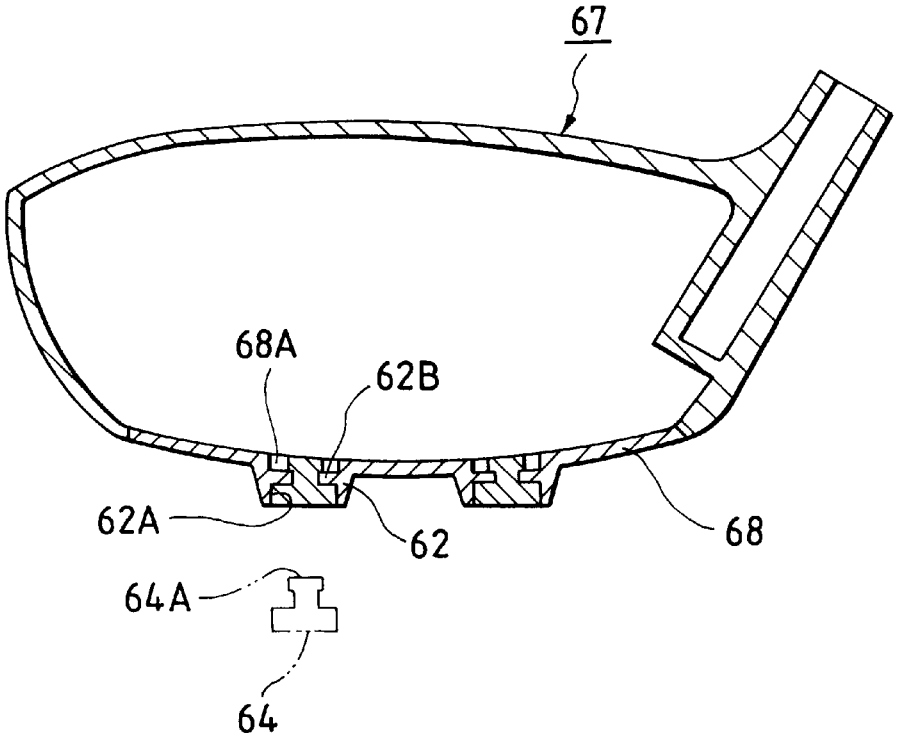
FIG. 9 is a longitudinal sectional view showing a golf club head which is yet another embodiment of the invention.
Figure 10:
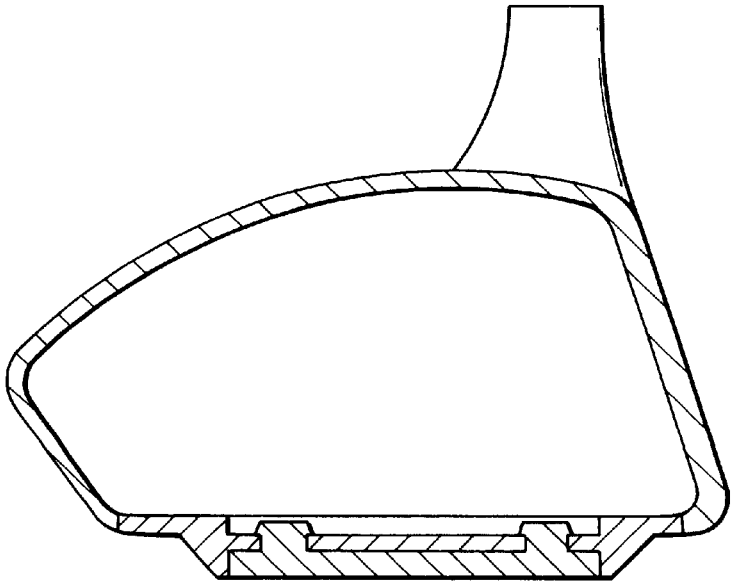
FIG. 10 is a cross sectional view showing the golf club head shown in FIG. 9.

FIGS. 9 and 10 show another golf club head 67 according to according to the present invention. A pair of parallel, elongating protrusions 62 are provided on a sole plate 68 of the golf club head 67. The sole plate 68 is welded to the opened lower end of the hollow shell. Each of the protrusions 62 has a recess 62A extending in the back-and-forth direction as shown in FIG. 9. A plurality of through-holes 62B are formed through a sole plate 68 so that the recess 62A of the protrusion 62 is communicated with the inside of the hollow shell. In this embodiment, two through holes 62B are provided for each recess 62A, and a recess 68A is formed on the inner side of the sole plate 68 to correspond to each recess 62A. An elongating weight 64 having a plurality of pins 64A is accommodated within each protrusion 62.

To assemble each weight 64 to the sole plate 68, the weight 64 is fit into each recess 62A of the protrusion 62 in a state that the pins 64A are respectively inserted into the through-holes 62B, and then the pressure is applied to the weight 64 in a vertical direction so that the distal end portions of the pins 64A are plastically deformed. With the thus deformed distal end portions of the pins 62B, the weight 64 is firmly attached to the sole plate 68. The sole plate 68 having the weights 64 thus firmly attached thereto is welded to the head body, and the exposed ends of the weights 64 exposed through the openings of the recesses 62A are polished utill those are flush with the tops of the protrusions 62.

While the weight member or members are fit into those recesses in the above-mentioned embodiments, the weight member or members may be buried or embedded in the recesses of the sole.

The present invention may also be applied to an iron-type golf club head, as a matter of course.

What is claimed is:

1. A golf club head comprising:

an integral hollow shell having a face adapted to strike a golf ball and a sole;

at least one elongated protrusion integral with said sole, said elongated protrusion extending in a swing direction and protruding downward from said sole; and at least one weight having larger specific gravity than the sole, said weight being at least partially accommodated within said protrusion and retained thereby.

2. A golf club head according to claim 1, wherein said protrusion has an opening at a protruding end thereof, and said weight is exposed through said opening.

3. A golf club head according to claim 2, wherein said weight is flush with said protruding end of said protrusion.

4. A golf club head according to claim 1, wherein said protrusion has a recess opened to an inside of the club head body, and said weight is received by said recess.

5. A golf club head according to claim 3, wherein said protrusion has a recess opened to an inside of the golf club head, and said weight is received by said recess.

6. A golf club head according to claim 4, wherein said recess substantially corresponds in shape to said protrusion.

7. A golf club head according to claim 2, wherein said weight engages with said opening.

8. A golf club head according to claim 2, wherein said protrusion has a recess at a protruding side thereof, and said weight is received by said recess.

9. A golf club head according to claim 8, wherein said sole has at least one through-hole through which said recess is communicated with an inside of the golf club head, and said weight is secured through said through-hole.

10. A golf club head according to claim 1, wherein a recess is formed in said protrusion, and said recess is located lower than an outer surface of said sole.

11. The golf club head according to claim 1, wherein said weight is an elongated weight.

12. A golf club head comprising a unitary hollow shell having a sole portion integral therewith and an opening adjacent a front end, said sole portion having at least one protrusion extending below said sole portion and defining a recess opened to an inside of said unitary hollow shell;

at least one weight member disposed in said at least one protrusion of said sole portion and secured thereto, a face plate secured to said unitary hollow shell adjacent to and closing said opening.

13. The golf club head according to claim 12, wherein said weight member includes a collar portion surrounding said weight member, said collar portion engaging an inner surface of said sole portion and secured thereto.

14. The golf club head according to claim 12, wherein said at least one protrusion includes two protrusions extending downward and along a length parallel to a swing direction substantially orthogonal to said face plate, said weight member comprising two elongated weight members one each disposed in said protrusions and extending in said swing direction, said two weight members being connected by a coupling part and having a collar portion surrounding said two weight members, said collar portion and said coupling part engaging an inner surface of said sole portion.

15. The golf club head according to claim 14, wherein said two weight members are adhered to an inner surface of said protrusions and said coupling part and said connecting part are adhered to said inner surface of said sole portion.

16. The golf club according to claim 13, wherein said collar portion is adhered to said inner surface of said sole portion.

17. A golf club head comprising:

a unitary hollow shell having a face plate adapted to strike a golf ball and an opening adjacent a bottom portion thereof a sole plate secured to said unitary hollow shell adjacent to and closing said opening, said sole plate having at least one protrusion defining a recess extending below said unitary hollow shell; and at least one weight member disposed in said at least one protrusion of said sole plate and secured thereto.

18. The golf club head according to claim 17, wherein said at least one protrusion comprises two elongated protrusions extending in a swing direction orthogonal to said face plate, said two elongated protrusions being substantially trapezoidal shaped in cross section, said at least one weight members comprises two weight members on each disposed in said protrusions and correspondingly shaped according to said trapezoidal shaped protrusions, said weight members being pressure fitted in said protrusions.

* * * * *